United States Patent [19]

Chow

[11] 4,413,023

[45] Nov. 1, 1983

[54] METHOD OF TREATING WOOD TO PREVENT STAIN AND DECAY

[75] Inventor: Suezone Chow, Richmond, Canada

[73] Assignee: Canadian Forest Products Ltd., Canada

[21] Appl. No.: 347,804

[22] Filed: Feb. 11, 1982

[30] Foreign Application Priority Data

Aug. 28, 1981 [CA] Canada ..... 384798

[51] Int. Cl.[3] ..... B05D 1/18; B05D 3/00; B05D 3/12

[52] U.S. Cl. ..... 427/325; 427/440; 427/441; 428/907

[58] Field of Search ..... 8/402; 427/325, 4, 384, 427/440, 441, 352, 353; 428/537, 907

[56] References Cited

U.S. PATENT DOCUMENTS 3,369,921 2/1968 Stutz et al. ..... 428/907 X 3,995,078 11/1976 Winn ..... 427/352

*Primary Examiner*—Michael R. Lusignan

*Attorney, Agent, or Firm*—Townsend and Townsend

[57] ABSTRACT

A method of treating wood to prevent stain and decay which includes extracting from a decay resistant species of wood material a fungi growth inhibiting material and using this material to wet the surface of wood to be treated. The substance for use as a fungi growth inhibiting material is obtained by extracting it from decay resistant species of wood material.

8 Claims, No Drawings

METHOD OF TREATING WOOD TO PREVENT STAIN AND DECAY

BACKGROUND OF THE INVENTION

This discovery relates to the treating of wood in order to prevent stain and decay during storage and to preserve the asethetic value and strength of wood.

Woods are known to have great variations in their decay resistance. Certain species such as western red cedar (*Thuja plicata*), yellow cedar (*Chamaecyparis nootkatensis D. Don*), yew (taxus spp.), redwood (*Sequoia spp.P* and teak (*Tectona grandis L*) are highly decay resistant. However, a large majority of the species which constitute the main volume of commercial lumber are less resistant to decay. These species, especially the sapwood, if exposed to air without kiln drying, will be subjected to fungal attack within a short period of time. In the warm summer months, the growth of fungus or wet lumber can be seen in 2 to 3 weeks. The first stage of a fungal attack produces black or blue stains. Although these biological stains do not reduce wood strength, they affect the aesthetic value of lumber. Futher growth of the fungi will result in decay which destroys the wood structure. Antistain treatment is therefore very important in lumber stored before drying or when lumber is shipped in the green condition. This is particularly important in international trade where green lumber is loaded into ships under warm and humid conditions and left for several months.

There are many commercial practices in the antistain and decay prevention treatment of lumber. The most effective chemicals are a family of chlorophenols such as pentachlorophenol and tetrachlorophenol in admixture with sodium hydroxide and borax in a water solution. The toxicity of the chlorophenol to humans and fish has been both a health and environmental concern for a considerable time. The discovery of a safe chemical with minimum toxicity is an urgent requirement for the wood industry.

SUMMARY OF THE INVENTION

According to the invention there is provided a method of treating wood to prevent stain and decay which includes extracting from a decay resistant species of wood material a fungi growth inhibiting material. The method further includes wetting the surface of wood to be treated with a solution of the extracted material. The treatment utilizes materials which offer a low fish toxicity for lumber in the green condition stored outside where it is exposed to fungal spores. Such protection is required during normal air seasoning or pending drying in a lumber drying kiln. It is also required to prevent fungal staining of green lumber resulting from loose piling and strapping during shipment in the green condition.

Preferably, the step of extracting includes contacting a decay resistant species of wood material with a suitable solvent for a sufficient time to extract fungi growth inhibiting chemicals from the wood.

The decay resistant species of wood may be western red cedar, yellow cedar, yew, red wood or teak. The extracting salt may be an alkaline water solution or any one of acetone, methyl alcohol, ethyl alcohol, water or a mixture of the foregoing.

An acceptable method of wetting the wood to be treated is by dipping the wood in a bath of the solution of the extracted material for at least 10 seconds.

In another aspect of the invention there is provided a substance for use as a fungi growth inhibiting material obtained by contacting a decay resistant species of wood material with a suitable solvent for a sufficient time to extract a solution of the substance.

The decay resistant species of wood may be western red cedar, yellow cedar, yew, redwood or teak or any mixture thereof.

The extracting solvent may be an alkaline water solution.

It has been found that the natural decay resistant extractives of western red cedar and yellow cedar can be tranferred to the surface of less decay and stain resistant commercial lumber species such as western hemlock, douglas fir, white spruce, lodgepole pine, ponderosa pine and others.

DESCRIPTION OF THE PREFERRED EMBODIMENT

The feasibility and effectiveness of extracting chemicals from decay resistant species utilizing solvents and then transferring these chemicals to less decay resistant species was subjected to investigation. This was then followed by an investigation as to whether this natural decay resistancy could be transferred to other less decay resistant species.

EXAMPLE 1

This experiment was intended to study fungal discoloration development in cedar-chemical treated lumber.

One kilogrm (oven-dry weight basis) of western red cedar hog fuel was exposed in a plastic container to 10 liters of water (20 C.) which contained 0.5% by weight of borax. The extraction time was four hours after which the solution was decanted for use.

Three freshly cut pieces of 2"×4" green hemlock sapwood, 4-foot long, were cut into 2-foot length samples. One sample from each was placed in one of two experimental groups: Group A—cedar/borax solution treatment and Group B—control. A fourth 4-foot long piece of similar lumber was also cut into 2-foot lengths, one of which was treated as in Group A and the other left untreated as a control. A piece of heavily infected 2"×4" ponderosa pine was sandwiched between the two hemlock pieces. This package constituted Group C.

The samples for treatment were soaked in the cedar/-water solution for about 30 seconds. A spore suspension of sapstain fungi and mold was collected from a surface of highly infected hemlock sapwood and mixed with water. This solution was then sprayed on the surfaces of the lumber in Group A and B in order to accelerate the test. All three lumber groups were separately wrapped in plastic bags and stored at 18° C. At certain periods of storage time, from 18 to 80 days, each package was opened for observation.

Effectiveness of the antistain treatment was evaluated according to an index of discoloration used by previous workers (J. W. Roff et al. Prevention of Sap Stain and Mold in Packaged Lumber. Western Forest Products Lab, Technical Report No. 14R, 43 p. 1980. The latter report is available to the public through Western Forest Products Ltd. in Vancouver, British Columbia). The discolorations were rated numerically as either "clear" (0)—without visible discoloration, "light" (1)—discoloration was present but wood grain was not obscured, "medium" (3)—a marked change in color and the grain was visible on only two-thirds of the wood surface, or "heavy" (6)—more than one-third of the wood grain was obscured by mold or stain.

Results of this experiment taken at different periods of storage are shown in Table 1.

TABLE 1

Discoloration Index of Cedar/Borax Solution Treated and Control Lumber

| Group | Samples | Storage Time (Days) 18 | 30 | 60 | 120 | 140 | 180 |
|---|---|---|---|---|---|---|---|
| A (treated) | 1 | 0 | 0 | 0 | 0 | 0 | 0 |
| | 2 | 0 | 0 | 0 | 0 | 0 | 0 |
| | 3 | 0 | 0 | 0 | 0 | 0 | 0 |
| B (control) | 1 | 0 | 0 | 0 | 1 | 3 | 6 |
| | 2 | 0 | 1 | 3 | 3 | 6 | 6 |
| | 3 | 0 | 1 | 1 | 3 | 6 | 6 |
| C (mixture) | control | 1 | 3 | 6 | 6 | 6 | 6 |
| | treated | 0 | 0 | 0 | 0 | 0 | 0 |

The above results indicate that the cedar extract is an effective chemical for the antistain treatment of wood.

EXAMPLE 2

This experiment was intended to study cedar extract's potential in preventing as well as suppressing fungi growth.

Three groups of samples were compared: control, cedar solution extracted with 0.5% borax in water and cedar solution extracted with water alone.

The cedar/borax/water and cedar/water solutions were prepared by soaking 7 kilograms (ovendry basis) of cedar hog fuel in 72 liters of water or 72 liters of 0.5% borax in water at about 10° C. (unheated indoor winter conditions) overnight prior to decanting.

Forty pieces of freshly cut 2"×4" green lumber, 12 feet in length, were obtained from a sawmill and cut into 4-foot samples. Two of the three samples cut from each piece were assigned for treatment with either the cedar/borax or the cedar/water solution and the third retained as a control. The samples for treatment were then soaked completely in the solutions for 10 to 30 seconds.

Fifty pieces of old 16-foot 2"×3" lumber which had been stored in the yard for over 3 months and were already contaminated with black stain were used as "seed" or infected material in order to speed up the testing process. These pieces of lumber were also cut into 4-foot lengths.

Three separate piles of lumber were made. One pile was treated wih the cedar/borax solution, one with the cedar solution, and one pile was used as a control. In each pile, freshly cut 2"×4" lumber was piled in alternate layers with 2"×3" "seed" lumber. One additional pile was made of the old "seed" lumber alone, but was treated with the cedar/borax solution without being mixed with any fresh lumber. All four groups of lumber were covered in plastic sheets and strapped tightly with steel bands. The packages were then stored in early spring inside an unheated building for 2 months and later moved outdoors for storage under summer conditions.

After 70 and 150 days, the packages were opened for inspection. Discoloration ratings were taken from both the cut ends and side faces of each piece of lumber. "Antistain Effectiveness" (ASE) was derived from the difference between the average of discoloration index for treated lumber and the average of discoloration index for untreated controls. ASE was then expressed as a percentage of this difference over the index for untreated controls.

Tables 2 and 3 show the percent distribution of the discoloration index, the percentage of pieces infected and the antistain effectiveness of the freshly cut 2"×4" green lumber after 70 days of storage.

TABLE 2

Antistain Effectiveness of Cedar/Borax and Cedar Extracts (70 days)

| | Lumber Surface | Discolor. Index | Treatment: Cedar/Borax R* | Cedar/Borax Dist. | Cedar R* | Cedar Dist. | Control R* | Control Dist. |
|---|---|---|---|---|---|---|---|---|
| | Side | 0 | 0.05 | 95.2% | 0.65 | 65.0% | 1.25 | 50.0% |
| | | 1 | | 4.8 | | 20.0 | | 28.0 |
| | | 3 | | 0.0 | | 15.0 | | 13.0 |
| | | 6 | | 0.0 | | 0.0 | | 10.0 |
| | Ends | 0 | 0.13 | 94.0% | 0.51 | 70.0% | 1.28 | 51.0% |
| | | 1 | | 2.4 | | 20.0 | | 22.5 |
| | | 3 | | 3.6 | | 10.0 | | 17.5 |
| | | 6 | | 0.6 | | 0.0 | | 10.0 |
| % of samples | Side | | | 4.8% | | 35.0% | | 50.0% |
| infected | Ends | | | 6.0 | | 30.0 | | 49.0 |
| Antistain | Side | | | 96.0% | | 48.0% | | 0.0% |
| Effectiveness | Ends | | | 90.0 | | 60.0 | | 0.0 |

*R - Average discoloration rating of all samples
Dist. — Distribution.
Each treatment consisted of 40 samples of 2" × 4' green lumber.

TABLE 3

Antistain Effectiveness of Cedar/Borax and Cedar Extracts (150 days)

| Discolor. Index | Treatment: Cedar/Borax R* | Cedar/Borax Dist. | Cedar R* | Cedar Dist. | Control R* | Control Dist. |
|---|---|---|---|---|---|---|
| 0 | 0.09 | 90.5% | 0.87 | 65.0% | 3.32 | 18.0% |
| 1 | | 9.5 | | 13.0 | | 15.0 |
| 3 | | 0 | | 20.0 | | 28.0 |
| 6 | | 0 | | 2.0 | | 39.0 |

TABLE 3-continued

| Antistain Effectiveness of Cedar/Borax and Cedar Extracts (150 days) | | | | | | |
|---|---|---|---|---|---|---|
| | Discolor. | Treatment | | | | |
| | | Cedar/Borax | | Cedar | | Control |
| | Index | R* | Dist. | R* | Dist. | R* | Dist. |
| % of samples infected | | | 9.5% | | 35.5% | | 82.0% |
| Antistain Effectiveness | | | 97.0 | | 74.0 | | 0 |

R* - Average discoloration rating of all samples.
Only the discoloration of the side surfaces of the lumber was recorded.

The above results indicated that the longer the storage time, the higher the antistain effectiveness of the cedar chemicals in comparison to that of control. After 150 days in storage, the control lumber showed an average discoloration of more than medium (3) and the majority of the lumber (39%) were heavily stained. The cedar chemical treated samples, on the other hand, showed an average discoloration of below light (1) for cedar/water treatment and clear (0) for the cedar/borax treatment. The antistain effectiveness were 75% and 100% for cedar/water and cedar/borax treatments, respectively.

The higher the antistain effectiveness of the cedar/-borax solution over that of the cedar solution was probably due to the greater extraction of the chemicals from the cedar wood with borax in the water solution.

Results for the old, infected 2"×3" lumber which received treatment of cedar/borax solution and stored for 70 days are shown in Table 4.

TABLE 4

| Capability of Cedar Chemicals to Suppress the Growth of Fungi on Infected Lumber | | | | | |
|---|---|---|---|---|---|
| | CEDAR/BORAX SOLUTION | | | | |
| Lumber | Discoloration | | | Samples | |
| Surface | Index | Ave. Rating | Dist. | Infected | ASE* |
| Side (old) | 0 | 1.71 | 10.7% | 89% | 50% |
| | 1 | | 54.0 | | |
| | 3 | | 32.0 | | |
| | 6 | | 4.0 | | |
| Ends (new) | 0 | 0.19 | 85.0% | 15% | 90% |
| | 1 | | 13.0 | | |
| | 3 | | 2.0 | | |
| | 6 | | 0.0 | | |
| | CONTROL WITHOUT TREATMENT | | | | |
| Side (old) | 0 | 3.36 | 7.0% | 93% | 0% |
| | 1 | | 20.7 | | |
| | 3 | | 39.6 | | |
| | 6 | | 32.7 | | |
| Ends (new) | 0 | 2.16 | 20.7% | 79% | 0% |
| | 1 | | 32.7 | | |
| | 3 | | 32.0 | | |
| | 6 | | 15.0 | | |

*ASE — Antistain Effectiveness

These results demonstrate that the cedar/borax solution can suppress the growth of fungi in already infected lumber as observed from the ratings of the side faces. The prevention of stain in the fresh end cuts is also evident in Table 4. The ASE ratings for the treatment of 2"×3" lumber were 90% for new end surfaces and 50% for old side surfaces.

These results indicate that the cedar chemicals cannot only minimize fungal growth on fresh lumber surfaces but also suppress to some degree the fungal growth in already infected wood.

EXAMPLE 3

This experiment was intended to further verify the biological stain preventative ability of cedar extractive chemical in the field storage of treated lumber without plastic sheet coverings.

A load of freshly cut 4"×4" hemlock lumber, 14 feet in length, was used as experimental material. Twenty pieces of the lumber were soaked in 1% cedar/borax solution for 10 to 30 seconds and then piled together in open air under warm and humid conditions (May-June). An additional 20 control pieces and the treated lumber were piled and placed side by side without plastic sheet coverage.

After four weeks, the control lumber developed black and blue stains with an average discoloration rating of 0.58; 31% of the pieces were infected. The treated lumber showed no sign of infection on any of the pieces. This result is additional evidence supporting the effectiveness of the cedar chemicals in antistain treatment, already shown in Examples 1 and 2.

EXAMPLE 4

This experiment was intended to study the influence of cedar extract concentration on antistain effectiveness.

Two freshly cut 2"×3" lumber pieces, each 3 feet in length and one old and infected 2"×3" lumber, 2 feet in length, all of which were hemlock sapwood, were cut into small samples ½" thick and 2"×3" in cross-section.

Five solution concentrations of sodium borate in water were prepared. They were 1%, 0.67%, 0.5%, 0.33%, 0.2% and 0% (control). The pH level of the solutions was 10 for 1% solution and decreased to about 9.5 at the 0.2% concentration. The pH level of city water is about 6.

Various strengths of the cedar chemicals extracted with borax water were prepared. The cedar sawdust was first extracted with 1% borax-water solution in a water/wood weight ratio of 10. The solids content in the extracted solution recovered by flash evaporation was found to be 1.5% of the weight of the solution. The actual cedar chemical extract excluding the borax was therefore 0.5%. This 1% cedar/borax solution was further diluted into four other concentrations: 0.34%, 0.25%, 0.15% and 0.10%, calculated on the basis of the cedar chemical content.

Six samples from the freshly cut lumber, 3 from each lumber piece and two samples from the infected lumber were used as a group for experimental purposes. The samples from the fresh lumber in each group were soaked in the appropriate solution for 10 to 30 seconds and wrapped with 2 untreated samples of infected lumber. The 8 samples were then wrapped in a plastic sheet and stored in a heated office (20° C.). A control group with 6 fresh samples and 2 infected samples was also wrapped together in a plastic sheet and stored.

After 75 days, the discoloration rating for the fresh samples and freshly cut surfaces of the infected samples were separately recorded. The number of infected pieces was tabulated from the samples of fresh lumber and their ASE for the old and new samples were compared. The samples were inspected with both a stereo microscope and the naked eye.

Results are shown in Table 5.

TABLE 5

Comparison of the Antistain Effectiveness of Different Borax Concentrations in Water

| Sample Groups | Borax Conc. | Discoloration Index (OLD) | Discoloration Index (NEW) | Samples Infected | ASE* (OLD) | ASE* (NEW) |
|---|---|---|---|---|---|---|
| 1B | 1.00% | 1 | 0** | 0% | 0% | 100% |
| 2B | 0.67 | 1 | 0.33 | 33 | 77 | 86 |
| 3B | 0.50 | 3 | 0.20 | 17 | 33 | 91 |
| 4B | 0.33 | 6 | 0.50 | 50 | 0 | 78 |
| 5B | 0.20 | 3 | 1.20 | 50 | 33 | 48 |
| 6B | 0 | 4.5 | 2.30 | 100 | 0 | 0 |

*ASE — Antistain effectiveness
**Although no visual stain observed by naked eye, massive development of white and black mycelia was observed under microscope.

The effectiveness of the cedar/borax solution in the antistain treatment of lumber is shown in Table 6.

TABLE 6

Comparison of the Antistain Effectiveness of Different Cedar/Borax Concentrations

| Sample Groups | Concentration Borax | Concentration Cedar | Discoloration Index (OLD) | Discoloration Index (NEW) | Samples Infected | ASE* (OLD) | ASE* (NEW) |
|---|---|---|---|---|---|---|---|
| 1BC | 1.00% | 0.50% | 0.5 | 0 | 0% | 89% | 100% |
| 2BC | 0.67 | 0.34 | 0.5 | 0 | 0 | 89 | 100 |
| 3BC | 0.50 | 0.25 | 0.5 | 0 | 0 | 89 | 100 |
| 4BC | 0.30 | 0.15 | 2.0 | 0 | 0 | 56 | 100 |
| 5BC | 0.20 | 0.10 | 2.0 | 0 | 0 | 56 | 100 |
| 6BC | 0 | 0 | 4.5 | 2.3 | 100 | 0 | 0 |

*ASE — Antistain effectiveness.

The above results prove that so long as a trace amount of the cedar extract remains in the water solution, then it retains antistain effectiveness. The use of the borax for extraction increases the efficiency of the cedar extract. In addition, the results from the infected samples in this experiment also suggest the ability of the cedar extract to suppress the growth of fungi in already infected wood.

EXAMPLE 5

To test the potential of the western red cedar and yellow cedar chemical extracts for stain prevention in spruce-pine-fir (SPE) wood, two each of 1"×4" cross-section and 2-feet long freshly cut white spruce and lodgepole pine sapwood lumber pieces were cut into thirty-two 1"×4" samples as experimental material. Two samples from each lumber piece were taken and placed in each group. A total of 8 groups of four wood samples each were assembled, two of which were kept as controls. A 2"×8" piece of highly infected ponderosa pine lumber was cut into eight 2"×8"×1" samples and used for accelerating the test.

Chemical extractions of yellow cedar with water alone and of yellow cedar and red cedar with 1% borax solution were prepared. The solution and wood weight ratio was 10. The extraction was done under room temperature (15° C.) for about 24 hours. The 1% borax solution was further diluted to 0.5% and 0.2% borax solutions for both red cedar and yellow cedar extracts. One group of the wood samples was then dipped into each of the six solutions for about 10 seconds. The samples were then wrapped in a plastic sheet with a piece of untreated, infected ponderosa pine wood and stored indoors at about 20° C.

The samples were first examined 20 days after treatment. The control without any treatment gave the average discoloration index of 3.14 while the samples treated with yellow cedar solution alone had an index of 1.0. The antistain effectiveness of the latter is 68%.

The effectiveness of the extracts from the red cedar and yellow cedar in borax solution are shown in the following table.

TABLE 7

Discoloration Index of Antistain Treatment

| | Borax Concentration 1.0% | Borax Concentration 0.5% | Borax Concentration 0.2% | Water Extracted Only | Control |
|---|---|---|---|---|---|
| Red Cedar Extract | | | | | |
| Ave. Discolor. Index | 0 | 0 | 1.28 | | 3.14 |
| ASE* (%) | 100 | 100 | 59 | | 0 |
| Yellow Cedar Extract | | | | | |
| Ave. Discolor. Index | 0.14 | 0 | 0.57 | 1.0 | 3.14 |
| ASE* (%) | 96 | 100 | 82 | 68 | 0 |

*ASE — Antistain Effectiveness

The above experimental results demonstrated the potential of red and yellow cedar extracts of antistain treatment of SPF wood. Their efficiency is enhanced by the addition of borax for extraction.

In addition to the above experiment with SPF wood, the chemicals from the yellow cedar extract with 1% borax solution was used for treating green hemlock wood. After 75 days of storage (as in example 4), the discoloration index and percentage infection were 0.

The above results indicated that the prevention of fungal stain development by both yellow cedar and red cedar extracts is equally applicable to all wood species tested.

EXAMPLE 6

This experiment was performed to test the antistain effectiveness of the cedar extractives for treating ponderosa pine (*Pinus ponderosa Laws*) sapwood which is considered to be the most susceptible to fungal attacks.

Four groups with three samples each of the ponderosa pine wood (1"×1"×1.2") were assembled. One of the groups was used as control and the other three groups were treated with solutions of western red cedar alone, 1% borax extraction of cedar and 0.5% borax extraction of cedar. The samples were placed in a sterilized 10 cm Petri dish. Each dish contained layers of damp paper towelling. The test samples were then streaked with stain fungi innoculum. They were checked after 30 days and after 60 days. The results are shown in Table 8.

TABLE 8

| Antistain Effectiveness of Cedar Solutions on Ponderosa Pine Sapwood | | | | | |
|---|---|---|---|---|---|
| Chemical Treatment | Sample Number | Discoloration Index 30 days | Discoloration Index 60 days | ASE* 30 days | ASE* 60 days |
| Control | 1 | 3 | 6 | | |
| | 2 | 3 | 6 | | |
| | 3 | 3 | 6 | | |
| | | Ave. 3 | Ave. 6 | 0 | 0 |
| Cedar Alone | 1 | 1 | 1 | | |
| | 2 | 3 | 6 | | |
| | 3 | 1 | 3 | | |
| | | Ave. 1.6 | Ave. 3.3 | 47 | 45 |
| Cedar/Borax (1%) | 1 | 1 | 1 | | |
| | 2 | 1 | 1 | | |
| | 3 | 1 | 1 | | |
| | | Ave. 1 | Ave. 1 | 67 | 83 |
| Cedar/Borax (0.5%) | 1 | 1 | 1 | | |
| | 2 | 1 | 1 | | |
| | 3 | 1 | 1 | | |
| | | Ave. 1 | Ave. 1 | 67 | 83 |

*ASE — Antistain Effectiveness.

The results indicated the effectiveness of red cedar extracts for antistain treatment of the most fungally susceptive ponderosa pine wood. The use of borax in the extraction appers to have synergistic affects on the antistain effectiveness of the treatment.

EXAMPLE 7

Chlorinated phenols are well known to be highly toxic both to fish and to humans. The toxicity to fish is rated by the use of the 96 hr. LC. 50 Index—being the concentration of the toxic component which will be lethal to 50% of the test fish in 96 hours of treatment under a standard set of conditions (J. C. Davis and R. A. W. Hoos, Use of Sodium Pentachlorophenate and Dehydroabietic Acid as Reference Toxicants for Salmonid Bioassays, J. Fish. Res. Board Can. Vol. 32(3) 411–16 (1975)). Comparative toxicities sodium pentachorophenate, an industrial antistain dip tank using a mixture of chlorinated phenols, and the western red cedar/1% borax solution used in Example 4 are given in Table 9.

TABLE 9

| A Comparison of Antistain Dip Tank Chemical with Cedar/Borax Solution | 96 Hr. LC 50 Parts per Million |
|---|---|
| Sodium Pentachlorophenate Powder | 0.03 to 0.12 |
| Industrial Dip Tank Solution | 145 |
| Cedar/Borax Solution | 17,500 |

As can be seen from Table 9, the cedar/borax solution is less than 1% as toxic as the present solutions used in industry antistain dip tanks.

GENERAL

The experimental results as shown in the above examples support the claim that the chemicals from decay resistant woods can be transferred to less decay resistant woods in order to prevent fungal stain and decay.

In the industrial process of chemical isolation, the wood extractives can be obtained by solvent or salt-solvent systems, or by steam distillation. Examples of solvents are water, methanol, ethanol, acetone, ammonium hydroxide, petroleum ether, benzene, ether, etc. Examples of salt-solvent systems are borax/water, boric acid/water/borax sodium hydroxide/water systems, etc. In practical application, the extractive solution can be directly applied to lumber by spraying or soaking. The solid-form extractves obtained by evaporation of the extracting solvent can be re-dissolved into othe solvents for application to the wood.

Other variations, departures and modifications lying within the spirit of the invention or the scope as defined by the appended claims will be obvious to those skilled in the art.

I claim:

1. A method of treating wood to prevent stain and decay comprising:

(a) extracting from a decay resistant species of wood material fungi growth inhibiting material;

(b) wetting the surface of wood to be treated with a solution of the extracted material.

2. A method of treating wood as defined by claim 1, wherein the step of extracting includes contacting a decay resistant species of wood material with a suitable solvent for a sufficient time to extract fungi growth inhibiting chemicals from the wood.

3. A method as defined in claim 1 or 2, wherein the decay resistant species of wood is selected from the group consisting of western red cedar and yellow cedar.

4. A method as defined in claim 2, wherein the extracting solvent is an alkaline water solution.

5. A method of treating wood as defined by claim 2 wherein the extracting solvent is selected from the group consisting of acetone, methyl alcohol, ethyl alcohol, water and any mixture of the foregoing.

6. A method of treating wood as defined by claim 1, 2 or 4, wherein the wetting step includes dipping the wood to be treated in a bath of a solution of the extracted material for at least 10 seconds.

7. A method of treating wood as defined by claims 1, 2 or 4, wherein the wetting step includes spraying the wood to be treated with a solution of the extracted material.

8. A method of treating wood as defined by claim 1 or 4, wherein the extracting solvent is borax in a water solution.

* * * * *